US007219897B2

(12) United States Patent
Sovine et al.

(10) Patent No.: US 7,219,897 B2
(45) Date of Patent: May 22, 2007

(54) TARGET

(75) Inventors: Addison Sovine, Provo, UT (US); Kyle Burdette, Provo, UT (US); Spencer Lambert, Provo, UT (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 11/337,768

(22) Filed: Jan. 23, 2006

(65) Prior Publication Data

US 2006/0255543 A1 Nov. 16, 2006

Related U.S. Application Data

(60) Continuation of application No. 10/873,020, filed on Jun. 21, 2004, which is a division of application No. 10/178,057, filed on Jun. 21, 2002, now Pat. No. 6,776,418.

(60) Provisional application No. 60/299,925, filed on Jun. 21, 2001.

(51) Int. Cl.
*F41J 7/04* (2006.01)

(52) U.S. Cl. ..... 273/390

(58) Field of Classification Search ..... 273/390–392, 273/406, 407

See application file for complete search history.

(56) References Cited

U.S. PATENT DOCUMENTS

| | | | | |
|---|---|---|---|---|
| 960,085 | A | | 5/1910 | Giles |
| 1,207,456 | A | | 12/1916 | Whelan |
| 1,348,283 | A | | 8/1920 | Koehl |
| 1,543,605 | A | | 6/1925 | Gavard |
| 2,008,359 | A | | 7/1935 | Lamb |
| 2,039,552 | A | | 5/1936 | Reynolds |
| 2,179,471 | A | | 11/1939 | Lee |
| 2,372,111 | A | | 3/1945 | Norberg |
| 2,587,042 | A | | 2/1952 | Haiselup |
| 2,591,984 | A | | 4/1952 | Walsh |
| 2,905,469 | A | | 9/1959 | Taylor |
| 4,614,345 | A | * | 9/1986 | Doughty ..... 273/381 |
| 4,691,925 | A | | 9/1987 | Scholem |
| 4,726,593 | A | * | 2/1988 | Wade ..... 273/392 |
| 4,739,996 | A | | 4/1988 | Vedder |
| 5,054,723 | A | | 10/1991 | Arnold |
| 5,232,227 | A | | 8/1993 | Bateman |
| 5,263,721 | A | | 11/1993 | Lowrance |
| 5,346,226 | A | | 9/1994 | Block |
| 5,352,170 | A | | 10/1994 | Condo et al. |
| 5,361,455 | A | | 11/1994 | Kiefer |

(Continued)

FOREIGN PATENT DOCUMENTS

GB 2187270 A 9/1987

*Primary Examiner*—Mark S. Graham
(74) *Attorney, Agent, or Firm*—Bateman IP Law Group

(57) ABSTRACT

A bullet target configured to improve the skills of a shooter includes, in one embodiment, a head plate which is attached to an arm by a resilient or semi-resilient attachment member to allow the head plate to visually deflect when hit by a bullet and to substantially return to its original position. In another embodiment, the improved target utilizes an attachment mechanism which allows the head to rotate relative to the arm within a stop to minimize transfer of vibrations between the head plate and the arm. In a third embodiment, a plurality of head plates are used in alignment and selectively exposed to the shooter to improve decision making ability.

30 Claims, 2 Drawing Sheets

U.S. PATENT DOCUMENTS

| | | | |
|---|---|---|---|
| 5,765,832 | A | 6/1998 | Huff |
| 5,934,678 | A | 8/1999 | Theissen et al. |
| 6,018,847 | A | 2/2000 | Lu |
| 6,332,243 | B1 | 12/2001 | Kim |
| 6,398,215 | B1 | 6/2002 | Carroll |
| 6,478,301 | B1 | 11/2002 | Witmeyer |
| 6,502,820 | B2 | 1/2003 | Slifko |
| 6,718,596 | B2 | 4/2004 | Kohlstrand et al. |
| 6,776,418 | B1 | 8/2004 | Sovine et al. |
| 6,808,177 | B2 | 10/2004 | Dehart |
| 6,994,348 | B2 | 2/2006 | Lambert et al. |
| 6,994,349 | B2 | 2/2006 | Lambert et al. |

* cited by examiner

TARGET

RELATED APPLICATIONS

The present application is a continuation application of U.S. patent application Ser. No. 10/873,020. filed Jun. 21, 2004, which is a divisional application of U.S. patent application Ser. No. 10/178,057, filed Jun. 21, 2002, now U.S. Pat. No. 6,776,418, which claims the benefit of U.S. Provisional Patent Application No. 60/299,925, filed Jun. 21, 2001.

BACKGROUND OF THE INVENTION

1. Field of the Invention

The present invention relates to a improved bullet targets. More specifically, the present invention relates to targets which improve the visual stimulation and/or function of the target to improve shooter abilities and to decrease broken targets.

2. State of the Art

In order to maintain proficiency in the use of firearms, it is common for law enforcement officers and sportsmen to engage in target practice. While many perceive target practice as simply a method for improving accuracy, it is important for law enforcement officers and the like to conduct target practice in scenarios which imitate real life situations. While accuracy is important for law enforcement officers, appropriate use of deadly force is even more important. While hitting a perpetrator in the arm or leg may cause some additional risk to the officer, firing at an innocent bystander or firing at a perpetrator who is not a risk raises greater concerns. Each year considerable controversy is raised by law enforcement officers who shoot unarmed individuals or otherwise use deadly force when not appropriate.

In order to properly train police officers, it is important that they develop both hand-eye coordination and that they receive sensor stimulation which is associated with actual conditions. Thus, it is important for law enforcement officers to be able to see when a target has been hit. It is also important that the target remain upright sufficiently to simulate the reactions of a typical target. Thus, for example, a target which falls when hit by a single shot may not provide appropriate stimulus to the officer, when a typical perpetrator would take several rounds before being sufficiently incapacitated that he would no longer pose a threat.

It is also important to train officers by requiring them to repeatedly be in situations in which they are forced to decide whether the target poses a threat within a fraction of a second. In real life situations, hesitating to fire can cost the officer his life. Firing too quickly can result in the death of an innocent party.

While there are high-tech shooting ranges which are configured to place an officer in a variety of situations, such shooting ranges are too expensive for many law enforcement agencies. Additionally, many existing shooting ranges cannot be readily adapted to use the technological advances. Thus, there is a need for simple bullet targets which provide improved situation stimulus and improved wear.

SUMMARY OF THE INVENTION

It is the object of the present invention to provide improvements in bullet targets.

In accordance with the above and other objects of the invention, an improved bullet target is provided, including a head plate which is configured to be impacted by a bullet, an arm for holding the head plate in a line of fire and an attachment mechanism for connecting the head plate to the arm.

In accordance with one aspect of the invention, the attachment mechanism is formed by a rubber block or some other resilient or semi-resilient material. The rubber block attaches the head plate to the arm in such a manner that the head will deflect each time it is hit but will substantially return to its initial position (generally vertical) shortly after the impact. Thus, the head gives the visual appearance of being impacted as it is hit with each bullet, consistent with the reaction of a person who has been struck by a bullet. The head plate, however, does not fall down after being struck by the preliminary round as is currently done in the prior art. Rather it returns to the original position or a position close thereto. Those skilled in the art will appreciate that this is more similar to many real life situations in which a perpetrator rushing a police officer will be momentarily stopped or knocked backward when hit by a round, and then will resume rushing the officer.

In accordance with another aspect of the present invention, the improved target includes a head plate which is attached to the arm by a stop. The stop is configured to allow the head plate to rotate between a first presented position and a second retracted position. As the head plate is hit by a bullet, the bullet rotates from the first presented position to the second retracted position. However, because no hinge is directly formed on the head plate, the head is able to withstand a larger number of rounds, and welds on the arms or stops last considerably longer.

In accordance with another aspect of the invention, the hinge formed between the arm or base and the head plate is formed from flat pieces of steel. Such a hinge is not only more durable than conventional hinges, it can be made relatively inexpensively from scraps of steel left over when making bullet traps, targets and the like.

In accordance with yet another aspect of the present invention, a pair of targets are disposed behind a chest plate. The targets are then selectively raised so that a user is selectively presented with targets having a color and/or shape representing an enemy and one representing an innocent party. The heads plates may be presented so that a single head is raised requiring the shooter to determine whether it is a target or not and then proceed with firing, if indicated, or the head plates may be advanced in unison so that the shooter first shoots the first target and then shoots the rear target, if appropriate.

In accordance with still another aspect of the invention, the targets can be presented to the shooter in alignment. Thus, the shooter may have to knock down the first target and then decide whether to fire at the second target, thereby forcing the shooter to closely monitor the status of the initial target. As will be appreciated, such a shooting scenario is analogous to shooting at a perpetrator, but ceasing the shooting as soon as the perpetrator falls to prevent shooting by-standers.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
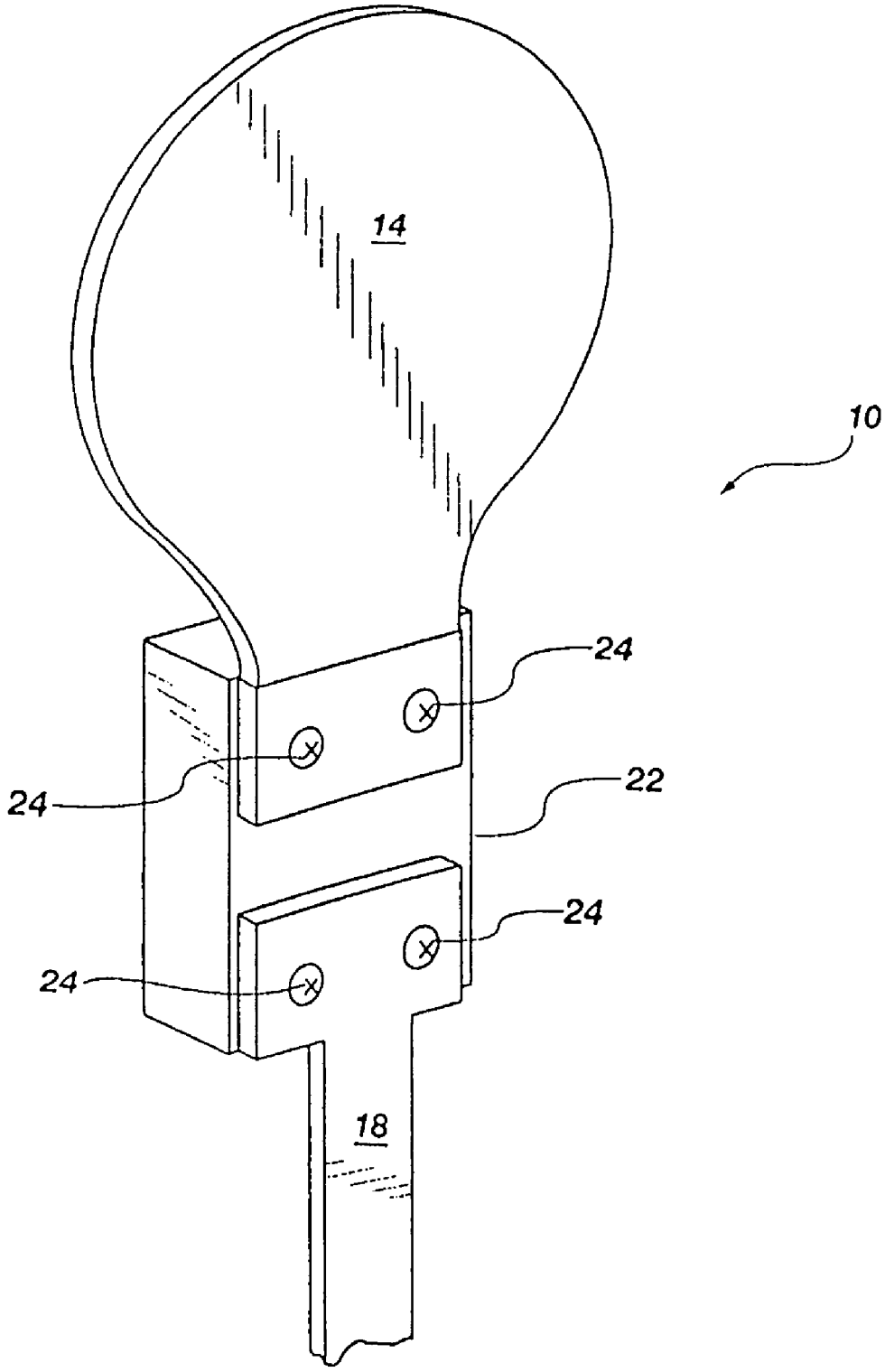
FIG. 1 shows a fragmented perspective view of an improved target made in accordance with the principles of the present invention.

Turning now to FIG. 1, there is shown a perspective view of an improved target, generally, indicated at 10, made in accordance with the principles of the present invention. The target includes a head plate 14 and an arm 18, which is used to hold the head plate in a line of fire.

Those skilled in the art will appreciate that current targets typically include a head plate which is attached to the arm by a hinge. Often this is formed by welding a pipe to the head plate and passing a bar through the pipe of the head plate so that a shot hitting the head plate causes the head plate to pivot downwardly with respect to the arm.

In accordance with the present invention, the head plate 14 is attached to the arm 18 by a resilient attachment member 22. Typically, the resilient attachment member 22 is formed from rubber, a spring or some other resilient or semi-resilient material.

The attachment member 22 is attached to the head plate 14 and to the arm 18 by screws 24, bolts, or some other fastener. Those skilled in the art will appreciate that it is preferable that such fasteners be configured to decrease the likelihood of ricochets.

In the present invention, the attachment member 22 provides both visual indication of impact on the head plate 14 while returning the head plate to a generally upright or facing position. In training law enforcement officials and military personnel to more accurately shoot, it is important that there be some visual indication when the target has been hit, as well as auditory information confirming the hit. In the prior art configuration, this was accomplished by the head plate making a noise upon impact of the bullet and pivoting downwardly following impact. This, however, allows for only a single shot to hit the target. In most common shooting situations, however, the initial shot is insufficient to bring down the enemy. Thus, in accordance with the present invention, the resilient or semi-resilient attachment mechanism deflects with each shot to provide a visual indication that the head plate of the target has been hit. However, the resilient attachment mechanism returns the head plate to a generally upright position allowing the shooter to repeatedly hit the target and thereby insure that a threat is no longer present.

Figure 2:
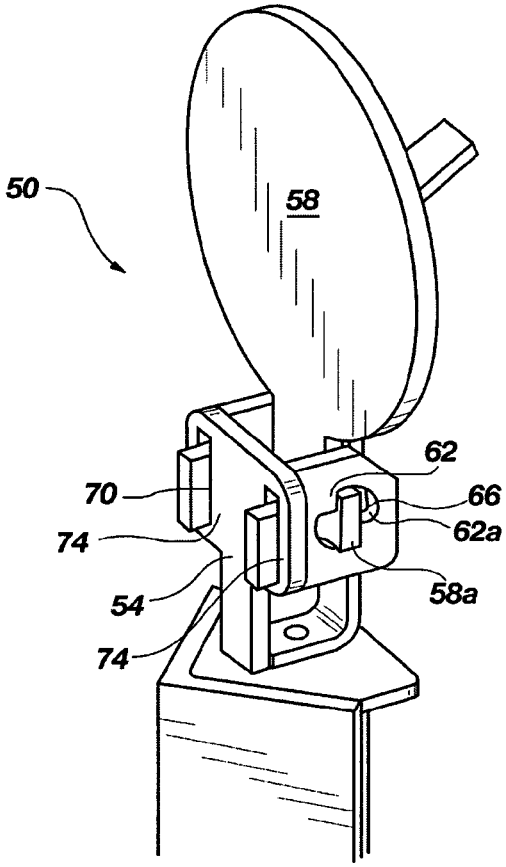
FIG. 2 shows a perspective view of another embodiment made in accordance with the principles of the present invention.

Turning now to FIG. 2, there is shown an alternate embodiment of an improved target, generally indicated at 50, made in accordance with the principles of the present invention. The target 50 includes an arm 54 and a head plate 58. The head plate 58 is held to the arm 54 by one or more stops 62. The stops 62 are typically formed from flat pieces of steel which have been cut. Because the pieces are flat, scrap steel left over from making bullet traps, head plates and the like can be used to form the hinge with relatively minor handling.

The stops have channels 66 formed therein and which are configured to allow a tab 58*a* of the head plate 58 to rotate between a generally vertical and a generally horizontal position. Unlike the previous embodiment, the head plate 58 is configured to fall into a generally horizontal position.

In additional to the above, the head plate 58 could fall 180 degrees if desired by simply modifying the configuration of the channels 66. Additionally, the configuration of the channel can be used to regulate how forceful of a hit or hits the head plate 58 must take before it will drop. The, for example, ledge 62*a* which defines part of the channel 66 could be raised on lowered to respectively increase or decrease the force necessary to tip the target.

In the prior art target, the head plate is pivotably attached to the arm. This is typically accomplished by welding a cylinder to the head plate and then extending a rod therethrough to act as a hinge. During repeat fire situations, the weld which holds the hinge in place breaks due to the vibration of repeated rounds hitting the head. This eventually causes the head plate to fall off. The head plate is then either thrown away, or recycled by welding another cylinder onto the head plate.

By having the head plate 58 pivot with respect to the stops 62 without being directly attached thereto, a substantial amount of the vibration is dissipated before the head plate impacts the back part of the channel 66 of the stop. This, in turn, reduces the amount of vibration which is conveyed to any weld 70 between the stops and the arm (or other base). Even if a weld 70 is present and breaks however, the head plate 58 may still be used so long as some retention interaction, such as a slotted groove engagement (sown by the clashed lines 74, exists between the head plate and the arm 54. It is appreciated from FIG. 2 that such a slotted groove engagement, as indicated by FIG. 2 and by dashed lines 74, may comprise holes formed in the arm 54 which receive a portion of the stops 62 and notches formed in the portions of the stops 62 which are received by the arm 54 and which engage the arm 54.

Yet another advantage of the configuration shown in FIG. 2 is that the configuration allows for ready replacement of targets. Because the head plate is not fixedly attached to the stops 62, the tabs 58*a* and channels 66 can have sufficiently loose tolerances that a head plate could be changed by simply sliding it to one side and then the other. This would allow an arm 54/stop 62 configuration to be quickly modified to provide a different target. Thus, for example, a head plate which is generally round could be used. The head plate could then be replaced with an tall, elongate head plate within a matter of a few seconds. By allowing quick changes, fewer arms or base units need to be purchased to use with a full array of head plates.

Figure 3:
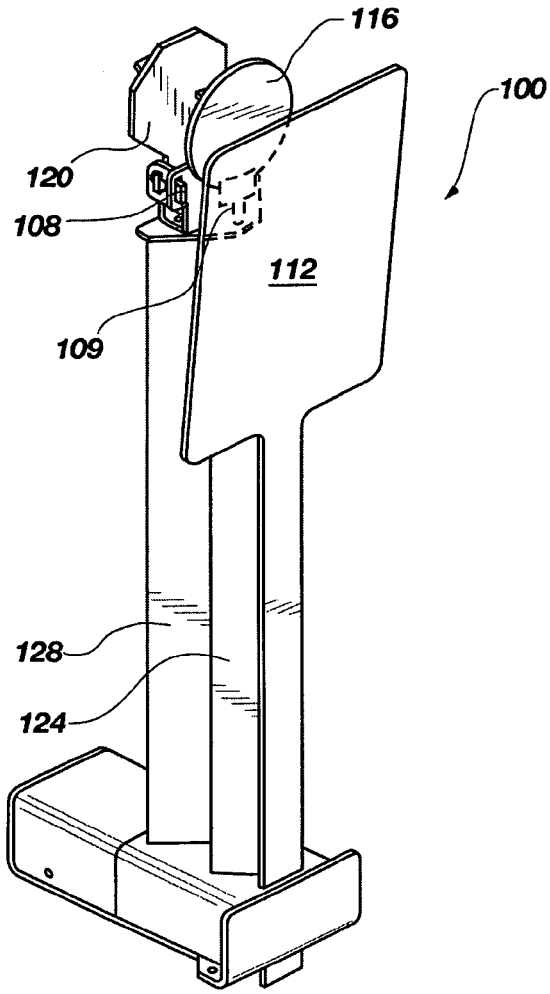
FIG. 3 shows a perspective view of a chest plate and a pair of bullet targets made in accordance with the principles of the present invention.

Turning now to FIG. 3, there is shown a perspective view of an improved target, generally indicated at 100, made in accordance with the principles of the present invention. The improved target 100 includes a first arm 104 and a second arm 108. The first and second arms 104 and 108 are positioned behind a chest plate 112, such as those which are commonly used for pop-up targets.

Attached on top of the first arm 104 is a target 116 having a first configuration. As shown in FIG. 3, the first target 116 is generally circular. The first target 116 is typically colored a first color, such as blue. In a preferred embodiment, the functional elements of the target can be configured similar to the target shown in FIG. 2 or to the target shown in FIG. 1.

Disposed on the top of the second arm 108 is a second target 120. The second target 120 is also preferably formed in a manner similar to that shown in FIG. 2, although other target configurations can be used. The second target 120 may have a second configuration which distinguishes it from the first configuration of the first target 116. Thus, for example, the second target may be hexagonal and painted a different color than the first target, i.e. red. Each of the arms 104 and 108 are mounted on top of a riser 124 and 128. The risers 124 and 128 selectively raise the targets 116 and 120 above the chest plate 112. The risers 124 and 128 allow the person controlling the range to selectively raise and lower either of the targets and thereby change the target which is presented to the shooter. The difference in the configuration of the first target 116 and the second target 120 forces the shooter to distinguish between a perpetrator and an innocent bystander. Thus, the shooter is not only tested on his ability to shoot accurately, but also to make split second decisions on whether or not to shoot.

While the risers 124 and 128 can be used to activate either of the targets, they can also actuate both targets 116 and 120 simultaneously. The person shooting is presented with the first target 116 which may indicate a perpetrator. When the target 116 has been hit sufficiently, the target will fall, revealing the second target 120. The second target 120 can be configured to represent an innocent bystander. In such a scenario, the shooter must immediately cease firing after the fall of the first target 116 to avoid hitting the innocent bystander represented by the second target 120.

In the alternative, the second target 120 could also be configured to represent a perpetrator. Thus, when the first target 116 falls, the shooter must quickly determine if the second target 120 represents a threat or not. By selectively changing the scenario, i.e. alternating targets representing an innocent bystander and a target representing a threat, the shooter can be conditioned to properly consider the target and to react accordingly.

Thus, there are disclosed several embodiments of improved targets which can be used to improve the shooting accuracy and decision making capacity of a shooter. Those skilled in the art will appreciate that there are numerous modifications which can be made without departing from the scope and spirit of the invention.

The invention claimed is:

1. A bullet target comprising:

a target head plate having a pair of tabs;

a hinge comprising:

the pair of tabs; and a pair of stops, each stop having a channel formed therein for receiving one of the tabs so as to allow rotation of the tab within the channel and thereby allow rotation of the head plate; and an arm having a pair of holes formed therein for receiving the pair of stops;

wherein each of the pair of stops comprises a notch formed therein, and wherein the notch engages the arm to thereby secure the stop to the arm; and wherein the stops slide through the holes in the arm in a first direction such that a portion of the stops passes through the holes in the arm and wherein the stops then slide in a second direction transverse to the first direction such that the notches engage the arm.

2. The target of claim 1, wherein the pair of stops are removably attached to the arm.

3. The target of claim 1, wherein the channels comprise ledges formed therein for limiting the rotation of the tabs and thereby limiting rotation of the head plate.

4. The target of claim 1, wherein the stops are disposed generally parallel to each other.

5. The target of claim 1, wherein the target head plate is formed from a flat piece of plate steel.

6. A bullet target comprising:

a target head plate having a pair of tabs;

a hinge comprising:

the pair of tabs; and a pair of stops, each stop having a channel formed therein for receiving one of the tabs so as to allow rotation of the tab within the channel and thereby allow rotation of the head plate; and an arm having a pair of holes formed therein for receiving the pair of stops;

wherein each of the pair of stops comprises a notch formed therein, and wherein the notch engages the arm to thereby secure the stop to the arm; and wherein the channels comprise ledges formed therein for limiting the rotation of the tabs and thereby limiting rotation of the head plate.

7. A bullet target comprising:

a target head plate formed as a single piece of plate steel;

a hinge for rotatably holding the head plate, the hinge comprising:

a pair of stops which receive a portion of the head plate to allow rotation of the head plate within the stops and thereby form a hinge; and an arm having a pair of holes formed therein which receive the pair of stops.

8. The target of claim 7, wherein the head plate comprises a pair of tabs, and wherein the pair of stops receive the pair of tabs.

9. The target of claim 7, wherein each of the pair of stops has a channel formed therein for receiving the portion of the head plate.

10. The target of claim 9, wherein the channels have ledges formed therein for limiting the rotation of the head plate.

11. The target of claim 7, wherein the each of the stops has a notch formed therein which engages the arm.

12. The target of claim 11, wherein the notches engage the holes formed in the arm.

13. The target of claim 7, wherein the stops extend through the holes in the arm.

14. The target of claim 7, wherein the holes in the arm define passages through the arm which are bounded on all sides by the arm.

15. A bullet target comprising:

a target head plate having a surface configured for receiving bullets and having a pair of tabs attached thereto; and a hinge comprising:

the pair of tabs; and a pair of stops, each of the stops having a channel formed therein for receiving a tab and for allowing the tab to rotate within the channel to thereby allow rotation of the head plate, and wherein the channels have ledges formed therein for limiting the rotation of the tabs.

16. The bullet target of claim 15, further comprising an arm having a pair of holes, and wherein the stops extend through the holes in the arm.

17. The bullet target of claim 16, wherein each of the stops has a notch formed therein.

18. The bullet target of claim 17, wherein the notches engage the arm to secure the stops.

19. The bullet target of claim 16, wherein the stops are slidably disposed in the holes.

20. The bullet target of claim 15, wherein the stops are generally parallel to each other.

21. The bullet target of claim 15, wherein each of the channels comprises a generally circular channel having a first ledge and a second ledge extending inwardly from an edge thereof the first ledge and second ledge being disposed on generally opposite sides of the channel.

22. The bullet target of claim 15, wherein the head plate is formed from a single piece of plate steel.

23. A bullet target comprising:

a target head plate;

a pair of stops having channels formed therein for rotatably receiving a portion of the target head plate so as to form a hinge; and wherein at least one of the channels has ledges formed therein for limiting the rotation of the portion of the head plate received therein to thereby limit rotation of the head plate.

24. The bullet target of claim 23, wherein each of the stops comprises a notch formed therein configured to engage a support structure.

25. The bullet target of claim 24, wherein the stops extend through holes in the support structure so as to extend beyond the support structure, and wherein the notches are formed in the portion of the stops extending through the holes such that the notches engage the support structure at the holes.

26. The bullet target of claim 23, wherein the stops are formed from plate steel.

27. The bullet target of claim 23, wherein the stops are configured to enable the target head to rotate about 90 degrees.

28. The bullet target of claim 25, wherein the stops are slidable into and out of the holes.

29. The bullet target of claim 23, wherein the target head plate comprises a steel plate having tabs formed thereon.

30. The bullet target of claim 25, wherein the holes in the support structure extend around the portion of the stops which extends through the support structure.

* * * * *

UNITED STATES PATENT AND TRADEMARK OFFICE

CERTIFICATE OF CORRECTION

PATENT NO. : 7,219,897 B2
APPLICATION NO. : 11/337768
DATED : May 22, 2007
INVENTOR(S) : Addison Sovine, Kyle Burdette and Spencer Lambert It is certified that error appears in the above-identified patent and that said Letters Patent is hereby corrected as shown below:

In the Drawings, Figure 2 is:

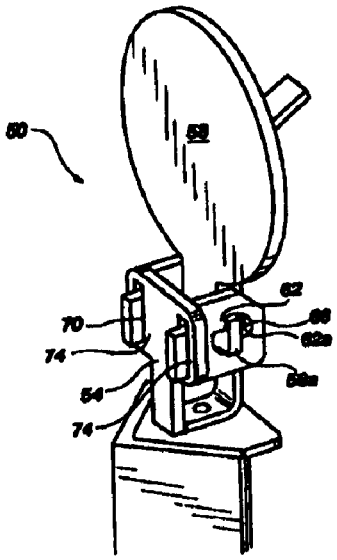

FIG. 2

Should be:

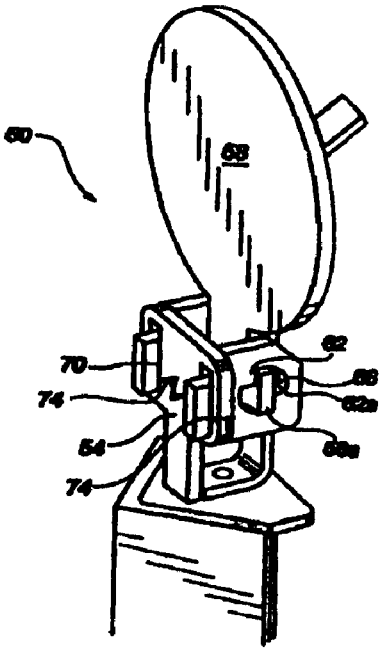

FIG. 2

UNITED STATES PATENT AND TRADEMARK OFFICE

CERTIFICATE OF CORRECTION

PATENT NO. : 7,219,897 B2
APPLICATION NO. : 11/337768
DATED : May 22, 2007
INVENTOR(S) : Addison Sovine, Kyle Burdette and Spencer Lambert It is certified that error appears in the above-identified patent and that said Letters Patent is hereby corrected as shown below:

Column 1:
Line 16 reads "The present invention relates to a improved …"; should read -- The present invention relates to an improved … --

Column 2:
Line 27 reads "bullet, the bullet rotates from …"; should read -- bullet, the head plate rotates from … --
Line 28 reads "…, because no hinge is"; should read -- …, because no weld is --
Line 43 reads "… The heads plates may be presented …"; should read -- … The head plates may be presented … --

Column 4:
Lines 34 and 35 read "… (sown by the clashed lines 74, exists between the head plate and the"; should read -- … (shown by the dashed lines 74), exists between the stops 62 and the --

Signed and Sealed this

Sixteenth Day of September, 2008

JON W. DUDAS
*Director of the United States Patent and Trademark Office*